US005737866A

United States Patent [19]

Minaire et al.

[11] Patent Number: 5,737,866

[45] Date of Patent: Apr. 14, 1998

[54] DEVICE FOR ADAPTING A SHOOTING AID ONTO AN INDIVIDUAL FIRE-ARM

[75] Inventors: Jean Minaire, Saint Priest en Jarez; Jean-Pierre Montgrenier, Veauche, both of France

[73] Assignee: Giat Industries, France

[21] Appl. No.: 776,033

[22] PCT Filed: May 21, 1996

[86] PCT No.: PCT/FR96/00757

§ 371 Date: Apr. 2, 1997

§ 102(e) Date: Apr. 2, 1997

[87] PCT Pub. No.: WO96/37749

PCT Pub. Date: Nov. 28, 1996

[30] Foreign Application Priority Data

May 23, 1995 [FR] France ..... 95 06134

[51] Int. Cl.[6] ..... F41A 35/00; F41C 3/14; F41G 1/00

[52] U.S. Cl. ..... 42/90; 42/100; 42/105; 89/41.17; 89/41.19

[58] Field of Search ..... 42/103, 100, 105, 42/90, 97; 89/41.17, 41.19; 33/245, 250; 403/349, 348, 321

[56] References Cited

U.S. PATENT DOCUMENTS

| | | | |
|---|---|---|---|
| 2,510,289 | 6/1950 | Livermore | 33/250 |
| 2,710,453 | 6/1955 | Beverly | 33/249 |
| 4,133,560 | 1/1979 | Ishikawa et al. | 403/349 |
| 4,295,287 | 10/1981 | Natzke et al. | 403/321 |
| 4,580,362 | 4/1986 | Stevens . | |
| 4,619,549 | 10/1986 | Gilbreth | 403/349 |
| 4,689,911 | 9/1987 | White | 42/105 |
| 4,733,489 | 3/1988 | Kurak | 42/105 |
| 5,067,386 | 11/1991 | Shiovitz et al. | 42/105 |
| 5,092,071 | 3/1992 | Moore | 42/103 |
| 5,107,612 | 4/1992 | Bechtel | 42/103 |
| 5,198,600 | 3/1993 | E'Nama . | |
| 5,284,399 | 2/1994 | Brustle et al. | 403/321 |
| 5,482,327 | 1/1996 | Schmid | 403/349 |
| 5,595,011 | 1/1997 | Gorslin | 42/100 |

FOREIGN PATENT DOCUMENTS

| | | |
|---|---|---|
| 0303585 | 2/1989 | European Pat. Off. . |
| 9006133 | 10/1990 | Germany . |
| 4133932 | 4/1993 | Germany . |
| 90/15371 | 8/1993 | WIPO . |

*Primary Examiner*—Michael J. Carone
*Assistant Examiner*—Theresa M. Wesson
*Attorney, Agent, or Firm*—Parkhurst & Wendel, L.L.P.

[57] ABSTRACT

Device for adapting shooting aids onto an individual fire-arm (1) at the vicinity of the front portion of the barrel, characterized in that it is comprised of a fixed element (8) integral with the fire-arm, and a removable element (13) which can be made integral with the fixed element (8) and the barrel (2) of the fire-arm. The shooting aid can be a laser designator or a grenade launcher.

7 Claims, 5 Drawing Sheets

DEVICE FOR ADAPTING A SHOOTING AID ONTO AN INDIVIDUAL FIRE-ARM

The technical field of the present invention concerns accessory adapters for individual firearms including grenade launchers, laser gunsights, torches or any other aim-enhancing launch device.

It is well known how to affix various accessories to individual firearms. Each kind of accessory is outfitted with a specific and as a rule stationary adapter entailing modification of the weapon, in machining some parts of the weapon, and sometimes in eliminating original components. Furthermore accessory disassembly and re-affixation requires special tools not with the firearm operator when on maneuvers. In such a case the weapon is assigned to a specific use and it follows that the said adapter might be non-exchangeable.

The U.S. Pat. No. 4,580,362 describes a complex adapter used in affixing a laser gunsight onto a weapon composed of a very large number of parts accurately mating one another. This adapter entails the drawbacks listed below.

The great drawbacks of the above cited weapon modifications is that they are irreversible, rendering the weapon specific and entailing idiosyncratic management and maintenance constraints.

Another drawback is the specificity of each adapter, that is, there are as many adaptater designs as there are accessories.

Still another drawback is the need for a skilled gunsmith to adapt the weapon or to move it to its initial destination so that degradation be less than irreversible.

The object of the present invention is to create a weapon accessory adapter entailing only minimal weapon modifications and applicable to different types of weapons in order to circumvent the above cited drawbacks.

Accordingly the object of the invention is an aim-enhancing accessory adapter for an individual firearm, said adapter being located near the front part of the barrel and being characterized by comprising:

a stationary component rigidly affixed to the weapon, and a detachable component which can be rigidly affixed to the stationary component and the weapon barrel.

In a preferred embodiment mode of the invention, the stationary component on one hand is located away from the free barrel-end and on the other hand it is rigidly affixed to the weapon at the front end of tube enclosing said weapon.

In general the detachable component consists of a longitudinal plate fitted at one end with a connector to the stationary component and at the other end with hookup means to the barrel.

In one embodiment, the stationary component and the hookup means are fitted with a quick-connect means of the bayonet type, said hookup means comprising an aperture in the stationary component and a tang extending the hookup means, hookup being implemented by rotating the detachable component by a quarter revolution.

In still another embodiment, the hookup means is in the form of a hook with a bow and opening, said opening matching the barrel diameter, the hook being kept in place by a support ring of the weapon entering the bow.

In a variation, the hook is fitted with a complementary hook rotatable inside the bow and capping the barrel by means of the ring.

In particular the adapter of the invention is appropriate to affixing a laser gunsight or a grenade launcher.

A foremost advantage of the invention is that adapter use is simplified, no specific tool being required.

Another advantage of the invention is the faithful reproducibility of affixation of the accessory to the weapon.

Another advantage of the invention is that weapon performance remains undegraded.

Other features and advantages of the invention are elucidated in the following description of the embodiments of the invention in relation to the attached drawings.

Figure 1:
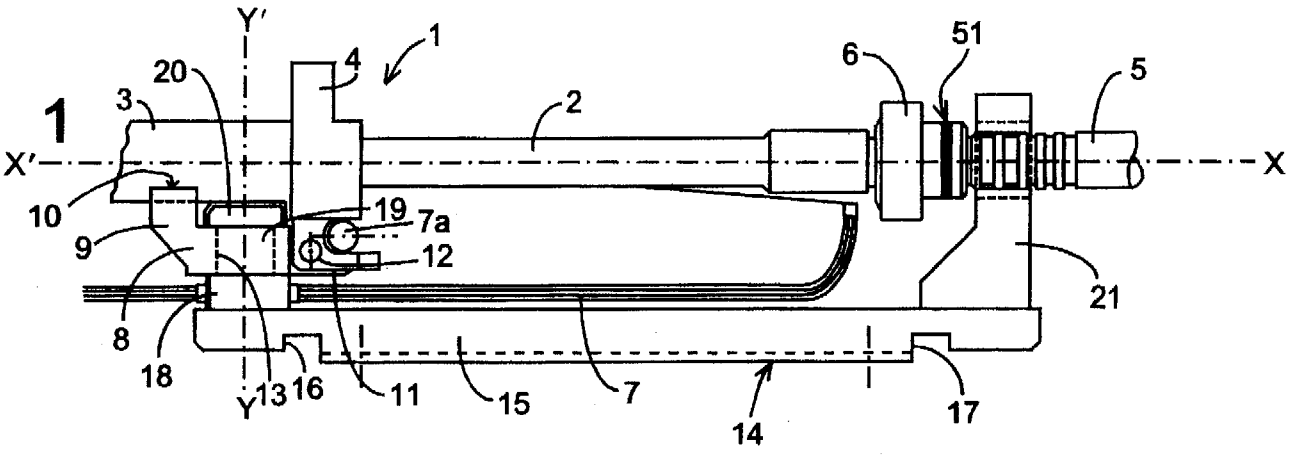
FIG. 1 is a section of the front portion of a weapon and shows the adapter.

From the above, the adapter may be used on all types of weapons, either directly on the barrel or on components enclosing the barrel. The description below describes an application of the invention to a particular weapon, but without implying limitation thereby. Thus FIG. 1 shows a weapon 1 of which the barrel 2 is protected in known manner by an enclosing tube 3 terminating in an end-fitting 4 insulating and supporting a number of components. At its free end 5, the barrel 2 is fitted with a detachable ring 6 commonly called the grenade support ring. The enclosing tube 3 and the barrel portion located between the ring 6 and the end-fitting 4 are protected by the stock 7.

The adapter of the invention comprises a stationary component 8 which may be permanently affixed to the enclosing tube 3 near the end-fitting 4. The overall shape of the component 8 is an L of which the end of one arm 9 rests on the zone 10 of the enclosing tube 3 near the end-fitting 4 and of which the other arm 11 is affixed by a pin 12 to the lower part of the end-fitting 4. The arm 11 comprises an aperture 13 used in hooking up a detachable component 14.

The detachable component 14 assumes the form of a longitudinal plate 15 serving on one hand to be affixed to the weapon using hookup means and on the other hand to receive the various accessories. It is understood that said shape may be matched to the particular accessory for instance by providing two notches 16 and 17 entered by studs rigidly part of the accessory. At one end the hookup means are constituted by a connector 18 extended by a radial tang 19 capped by a head 20 while they are composed at the other end of a hook 21 matching the barrel 2.

Figures 2, 3:
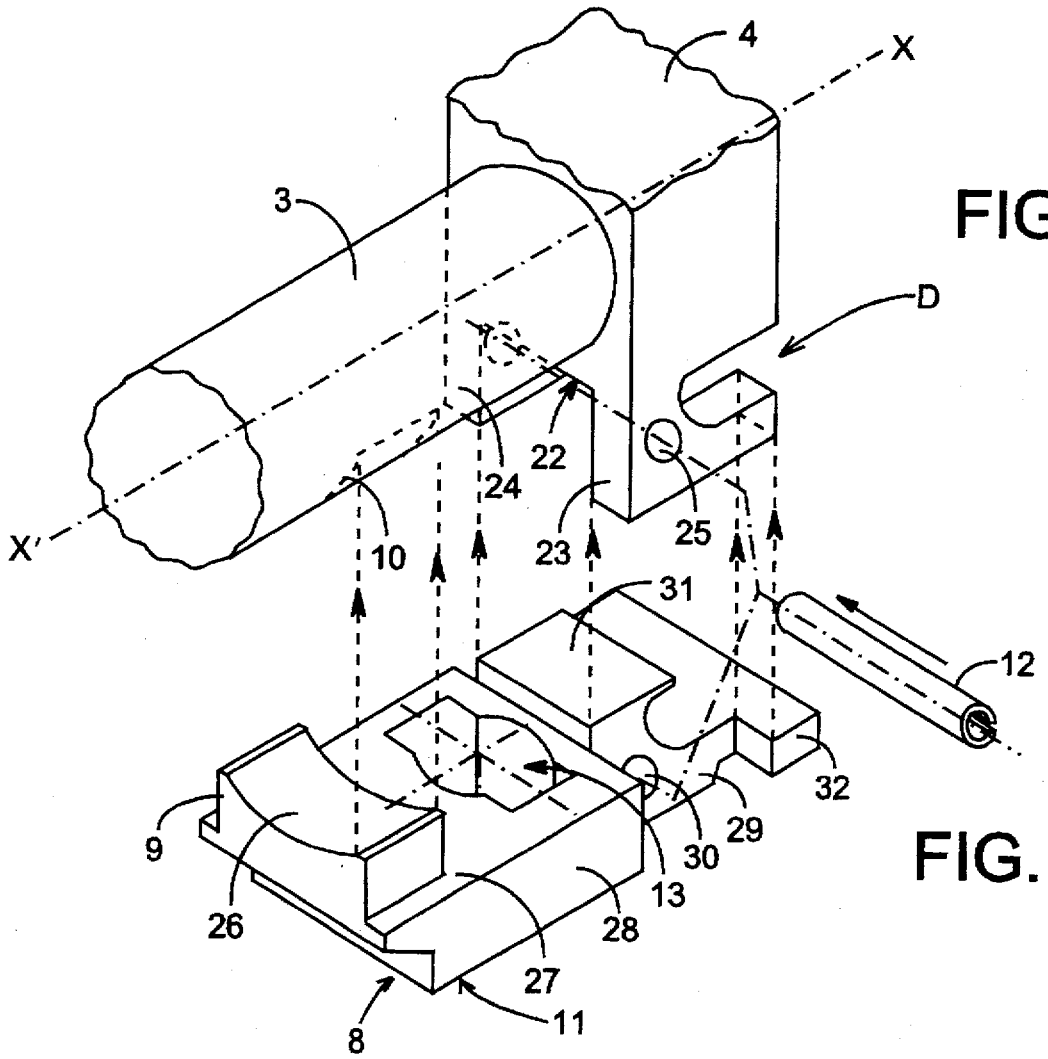
FIG. 2 is a perspective of part of the tube enclosing the weapon.
FIG. 3 is a perspective of the stationary component of the adapter.

FIG. 2 is a perspective of the end-fitting 4 extending the enclosing tube 3 which is coaxial with the xx' axis of the weapon barrel. The end-fitting 4 assumes the overall shape of a parallelipiped comprising at its base a clearance 22 bounding two side faces 23 and 24. These two faces are perforated by a transverse hole 25 receiving the pin 12. The cutout D receives a pin 7*a*(FIG. 1) hooking up the assembly to the weapon stock 7.

FIG. 3 is a perspective of the component 8 affixed to the tube 3 which is rigidly joined to the end-fitting 4. For that purpose the arm 9 comprises an upper surface 26 of which the topology matches that of the enclosing tube 3 of the weapon barrel 2 on which it rests. The height of this arm 9 is calculated so that when said arm rests on the barrel, the head 20 shall rest on the upper plane surface 27 of a first portion of the arm 11. This portion 28 is extended by a second portion 29 crossed by a duct 30 and comprises a lip 31 which shall enter the clearance 22 and which is terminated at each side by stud 32. Accordingly, when the component 8 is moved onto the weapon and after forcing the arm 9 against the zone 10, the lip 31 comes to rest against the bottom of the clearance 22, whereupon the pin 12 may be engaged across the holes 25 and the duct 30. The two studs 32 are forced against the forward surface of the end-fitting 4. Therefore the component 8 is fully locked relative to the end-fitting.

Figure 4:
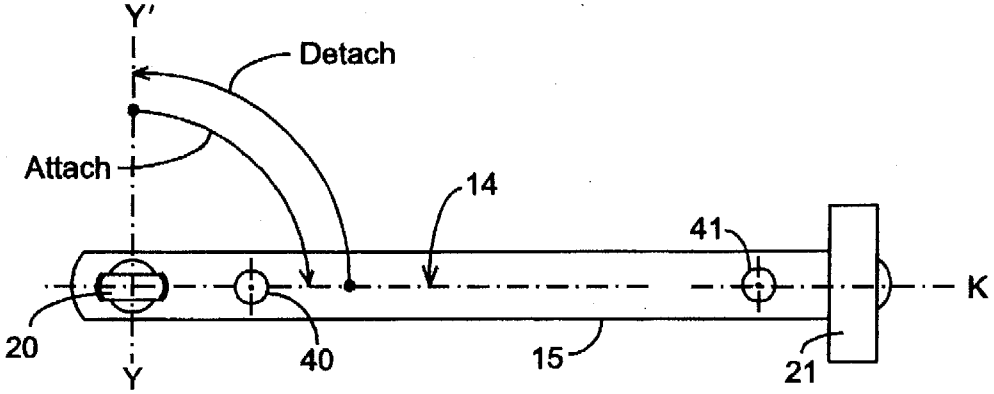
FIG. 4 is a topview of the detachable component of the adapter.

The detachable component 14 shown in topview in FIG. 4 comprises two boreholes 40 and 41 serving to affix the accessory for instance using screws. Obviously any other affixation system, for instance clamps or snap-fasteners also may be used.

FIG. 4 also shows that the head 20 is a parallelipipedic part of which the larger base is aligned with the K axis of the plate 15.

Figure 5:
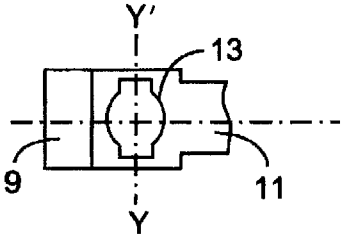
FIG. 5 is a partial topview of the stationary component.

FIG. 5 shows the shape of the aperture 13 matching the shape of the tang 19 and of the head 20. This aperture 13 assumes an overall parallelipipedic shape of which the large base runs along a yy' axis perpendicular to the xx' axis of the barrel 2, said aperture widening at its center to receive the tang 19. Therefore, when the tang 19 is inserted in the aperture 19 along the yy' axis, the head 20 shall become flush with the arm 11 against which it will rest as explained below.

Figure 6A:
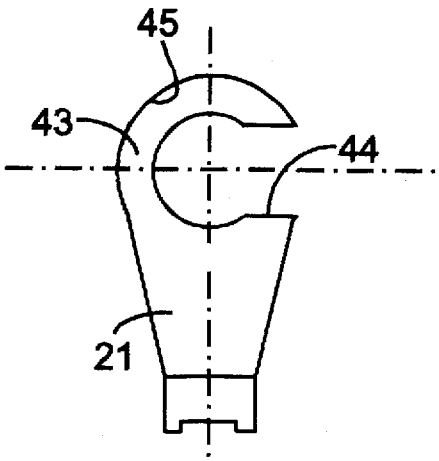
FIGS. 6A, 6B are sections of the hookup means.
Figure 6B:
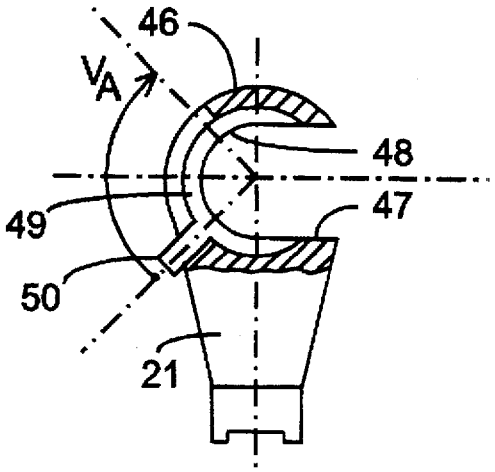

FIGS. 6A and 6B are longitudinal sections along an axis perpendicular to the K axis of the plate 15 and represent two embodiments of the hookup means 21 on the barrel 2 by means of the ring 6 (FIG. 1).

As shown by FIG. 6A, the hookup means is in the form of a hook 43 evincing an opening 44 and a bow 45. The opening 44 matches the diameter of the barrel 2 and the bow 45 is of a diameter slightly larger than that of the weapon ring 6.

As shown by FIG. 6B, the hookup means also may be in the form of a hook 46 evincing an opening 47 and a bow 48. In this embodiment the bow and opening dimensions are substantially larger than the diameter of the ring 6, however the hook 46 is fitted with a complementary hook 49 rotationally movable relative to the hook by means of a stud 50. Thereby, when actuating the stud 50, the complementary hook 49 shall implement—around the ring 6—the closure and locking of the hook 46 relative to said ring 6 which is rigidly affixed to the barrel 2.

The adapter is assembled to the weapon in the following manner, it being understood that the accessory can be affixed to the plate 15 either before or after being fastened to the weapon. The stationary component 8 is included already in the design of the weapon or else it will be retrofitted to it. In the former case, the component 8 may be integral with the end-fitting 4. The detachable component 14 is aligned with the yy' axis and thereby it is possible to insert the head 20 into the aperture 13. When the head emerges from the aperture, the plate 15 is bent back by a quarter revolution toward the weapon and thereupon the head 20 rests against the arm 11, thus implementing the connection between the stationary component 8 and the detachable component 14. Simultaneously the hook 43 or 46 is placed around the barrel 2 or the ring 6. Locking the hook 43 is carried out by translating the movable ring 6 on the weapon barrel in such manner that said ring shall be entering the bow 45. By locking the hook 46 directly capping the ring 6, the component 14 is fastened on the weapon. Next the stud 50 of the complementary hook 49 is actuated and thereupon said complementary hook partly or totally closes the opening 47.

In general the ring 6 is fitted with a spring 51 (FIG. 1) and the hook 43 or 46 is made to rest on said spring, further the said ring is made to be stationary or movable in order to compensate the mechanical play between the hook and the ring and to achieve good locking localization.

Dis-assembly is carried out in reverse manner. The adapter of the invention also allows satisfactory alignment of the accessory on the barrel axis and can be matched to diverse accessories while maximally preserving the original weapon functions. Only one modification is required to affix the stationary component, and no tool whatever is used for affixation and dis-assembly.

Figure 7:
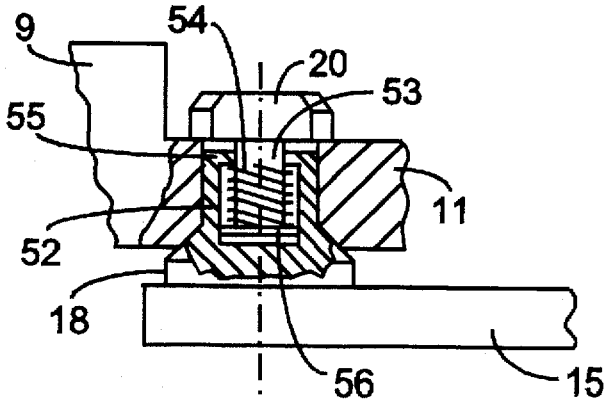
FIG. 7 is a section of a play compensating system for the hookup means.

FIG. 7 illustrates a particular implementation of compensating play between the stationary component 8 and the detachable component 14. For that purpose the connector 18 comprises a telescoping tang. Said tang comprises a hollow base 52 entered by a shaft 53 outwardly continued by the head 20. A spring 54 is mounted between a shoulder 55 of the hollow base 52 and a shoulder 56 of the shaft 53. As a result the elastic assembly so implemented allows compensating the vertical assembly play between the aperture 13 and the shaft 53. This configuration more particularly is applicable to an accessory of the laser gunsight type. In case more accurate centering is desired, a cone may be added near the shaft 53 to eliminate the lateral play in the connector.

Figure 8:
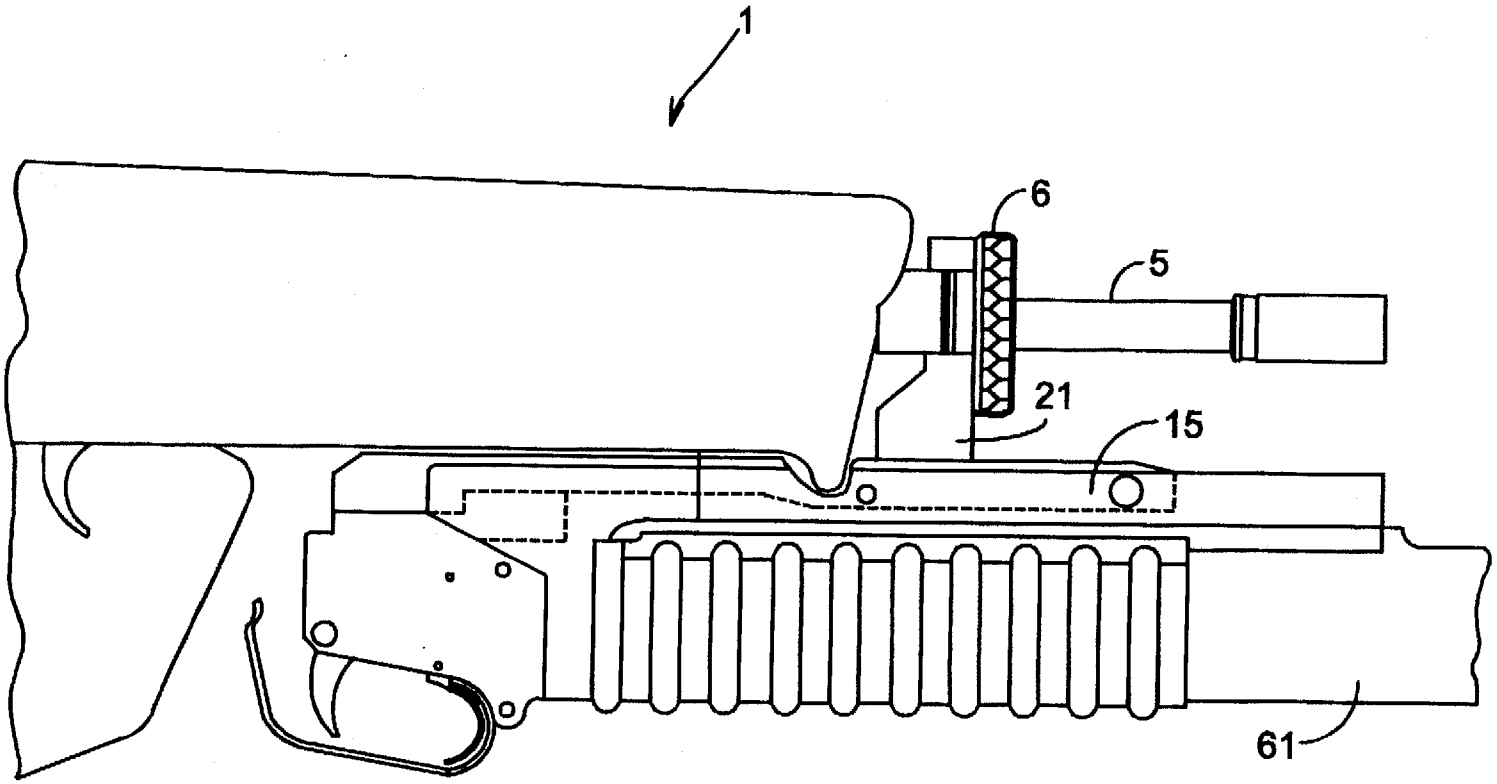
FIGS. 8, 9 are two illustrative embodiments of how to affix accessories to a weapon.

FIG. 8 shows assembling a grenade launcher 61 using the adapter. This adapter being bulkier than a laser gunsight, the plate 15 is extended beyond the hookup means 21 bearing the hook 49. In this instance the weapon 1 is fitted with a stationary ring 6.

Figure 9:
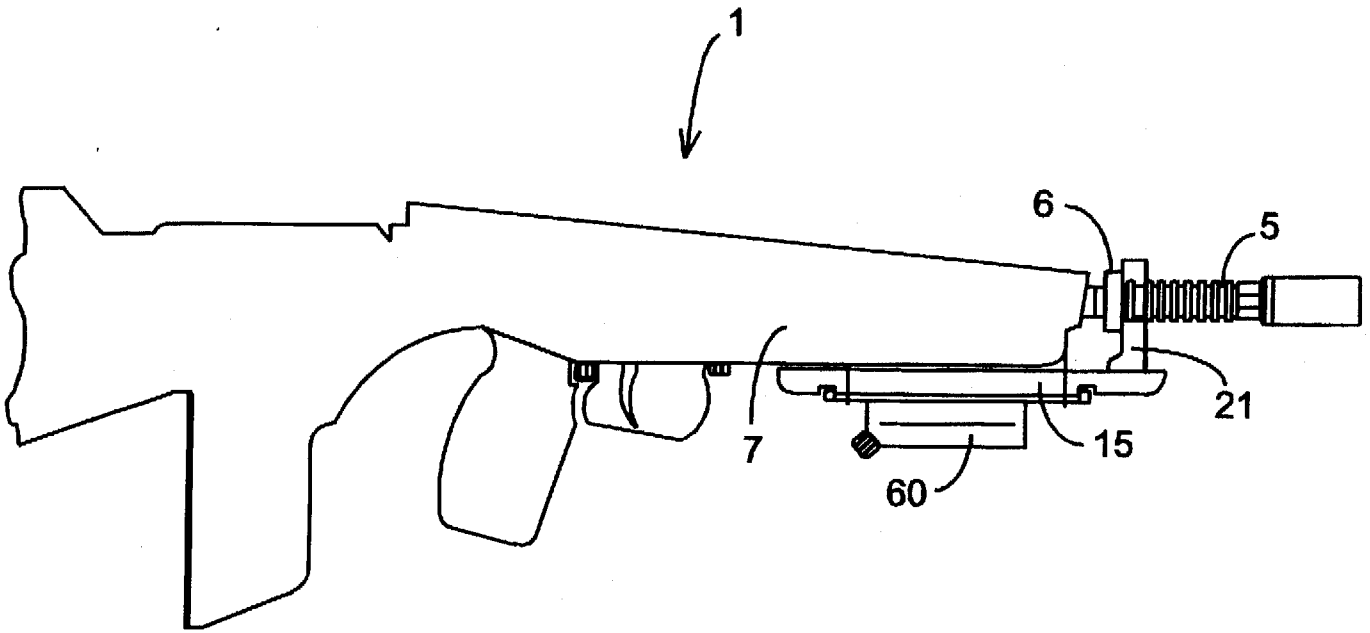

FIG. 9 shows the affixation of the adapter fitting a weapon 1 with a laser gunsight 60. Such affixation is rigorously identical with that described in relation to FIG. 1, comprising engagement of the ring 6 in the hook 43.

We claim:

1. An adapter for mounting shooting accessories to an individual firearm in the vicinity of the front of a barrel, comprising:

a stationary component rigidly joined to the firearm and located opposite the end of a barrel from which a projectile exits;

a removable component that can be affixed to the stationary component;

said removable component having a longitudinal plate with a connector at one end to connect to the stationary component and an attachment element at the other end to attach to the front of the barrel; and hookup means whereby said stationary component is rigidly joined to the connector of said removable component by a quick-connect bayonet mount.

2. An adapter as in claim 1, wherein the hookup means further comprises an aperture in the stationary component and a tang extending from the connector.

3. An adapter as in claim 2, wherein the hookup means further comprises a removable component which is rotatable by a quarter revolution.

4. An adapter as in claim 1, wherein the hookup means comprises a hook having a bow and an opening matching the diameter of the barrel, the hook being kept in place by a weapon support ring entering the bow.

5. An adapter as in claim 1, wherein the hookup means is composed comprises a hook having a bow and an opening matching the diameter of a weapon support ring, the hook being fitted with a complementary hook rotatable in the bow and serving to surround the barrel by means of a weapon support ring.

6. An adapter as claim 1, further comprising:

the stationary component is rigidly affixed to the firearm near the rear end of the barrel.

7. An adapter according to claim 1, wherein said stationary component and said removable component are affixed to at least one of a laser gunsight or a grenade launcher.

* * * * *